US009601237B2

(12) United States Patent
Mueller et al.

(10) Patent No.: US 9,601,237 B2
(45) Date of Patent: Mar. 21, 2017

(54) TRANSMISSION LINE FOR WIRED PIPE, AND METHOD

(71) Applicants: Stephan Mueller, Hannover (DE); Ingo Roders, Seelze (DE); Rene Schulz, Hambuhren (DE); Henning Rahn, Celle (DE); Robert Buda, Celle (DE); Detlev Benedict, Celle (DE)

(72) Inventors: Stephan Mueller, Hannover (DE); Ingo Roders, Seelze (DE); Rene Schulz, Hambuhren (DE); Henning Rahn, Celle (DE); Robert Buda, Celle (DE); Detlev Benedict, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 176 days.

(21) Appl. No.: 14/194,991

(22) Filed: Mar. 3, 2014

(65) Prior Publication Data

US 2015/0248950 A1 Sep. 3, 2015

(51) Int. Cl.
*H01B 3/10* (2006.01)
*H01B 7/28* (2006.01)
(Continued)

(52) U.S. Cl.
CPC ..... *H01B 7/28* (2013.01); *E21B 17/00* (2013.01); *H01B 7/16* (2013.01); *H01B 11/1895* (2013.01);
(Continued)

(58) Field of Classification Search
CPC .. C23F 13/02; H01B 7/16; H01B 7/28; H01B 7/046; H01B 7/207; H01B 9/04; H01B 9/003; H01B 11/18; H01B 11/1808; H01B 11/1869; H01B 11/1895; H01B 13/06; H01R 4/66; H01R 13/533; H01R 43/00; H05B 3/141; E21B 17/00; E21B 36/04; E21B 43/12; E21B 43/24; E21B 43/38;
(Continued)

(56) References Cited

U.S. PATENT DOCUMENTS 3,773,109 A 11/1973 Eberline
3,855,468 A 12/1974 Pitts, Jr.
(Continued)

FOREIGN PATENT DOCUMENTS

EP 0778590 A2 11/1997
EP 1065674 A2 1/2001
JP 8227620 A2 2/1995

OTHER PUBLICATIONS

Times Microwave Systems, "Si02 Coaxial Cable Assemblies", Sep. 2007, [retrieved on Oct. 29, 2013]. Retrieved from the internet: URL:http://www.timesmicrowave.com/downloads/products/sio2_single_pages.pdf, 4 pages.

*Primary Examiner* — Timothy Thompson
*Assistant Examiner* — Guillermo Egoavil
(74) *Attorney, Agent, or Firm* — Cantor Colburn LLP

(57) ABSTRACT

A wired pipe transmission line for disposal in a wired pipe segment for use in subterranean drilling. The transmission line includes an assembly including an inner conductor and a dielectric layer including silicon dioxide ($SiO_2$) insulating material surrounding the inner conductor and a protective layer that is formed of a rigid material and surrounding the dielectric layer. Also included is a method of forming a wired pipe transmission line.

5 Claims, 4 Drawing Sheets

(51) Int. Cl.

| | |
|---|---|
| ***E21B 17/00*** | (2006.01) |
| *H01R 13/533* | (2006.01) |
| *H01B 7/16* | (2006.01) |
| *H01B 11/18* | (2006.01) |

(52) U.S. Cl.
CPC ..... *H01R 13/533* (2013.01); *Y10T 29/49117* (2015.01); *Y10T 29/49174* (2015.01)

(58) Field of Classification Search
CPC ..... E21B 43/122; E21B 43/2401; E21B 43/2405; F16C 2202/28; Y10T 29/49117; Y10T 29/49174
USPC ..... 174/110 A; 166/248, 65.1; 204/290.7, 204/294; 219/542
See application file for complete search history.

(56) References Cited

U.S. PATENT DOCUMENTS

| | | | | |
|---|---|---|---|---|
| 3,857,776 | A | 12/1974 | Titus et al. | |
| 4,139,936 | A | 2/1979 | Abrams et al. | |
| 4,250,351 | A | 2/1981 | Bridges | |
| 4,378,464 | A | 3/1983 | Marmignon et al. | |
| 6,452,105 | B2 | 9/2002 | Badii et al. | |
| 6,982,384 | B2 | 1/2006 | Hall et al. | |
| 7,119,283 | B1 | 10/2006 | Varkey et al. | |
| 8,528,651 | B2 | 9/2013 | Darby et al. | |
| 2011/0042084 | A1* | 2/2011 | Bos | E21B 43/243 166/272.1 |
| 2013/0206748 | A1* | 8/2013 | Vinegar | E21B 36/04 219/542 |
| 2014/0190691 | A1* | 7/2014 | Vinegar | B09C 1/02 166/272.1 |

* cited by examiner

TRANSMISSION LINE FOR WIRED PIPE, AND METHOD

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various coupling mechanisms, such as threaded couplings.

Pipe segments can be connected with tool joints that include a threaded male-female configuration often referred to as a pin-box connection. The pin-box connection includes a male member, i.e., a "pin end" that includes an exterior threaded portion, and a female member, i.e., a "box end", that includes an interior threaded portion and is configured to receive the pin end in a threaded connection Various power and/or communication signals may be transmitted through the pipe segments via a "wired pipe" configuration. Such configurations include electrical, optical or other conductors extending along the length of selected pipe segments. The conductors are operably connected between pipe segments by a variety of coupling configurations.

Some wired pipe configurations include a transmission device mounted on the tip of the pin as well as in the box end. The transmission device, or "coupler," can transmit power, data or both to an adjacent coupler. The coupler in the pin end might be connected via a coaxial cable to the coupler in the box end.

BRIEF DESCRIPTION

Disclosed herein is a wired pipe transmission line for disposal in a wired pipe segment for use in subterranean drilling. The transmission line includes an assembly including an inner conductor and a dielectric layer including silicon dioxide ($SiO_2$) insulating material surrounding the inner conductor and a protective layer that is formed of a rigid material and surrounding the dielectric layer.

Also disclosed is a method of forming a wired pipe transmission line that includes: providing an assembly that includes an inner conductor surrounded by a silicon dioxide ($SiO_2$) insulating material and a protective layer surrounding the silicon dioxide ($SiO_2$) insulating material; and welding a sealing sleeve to the protective layer at an end of the assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
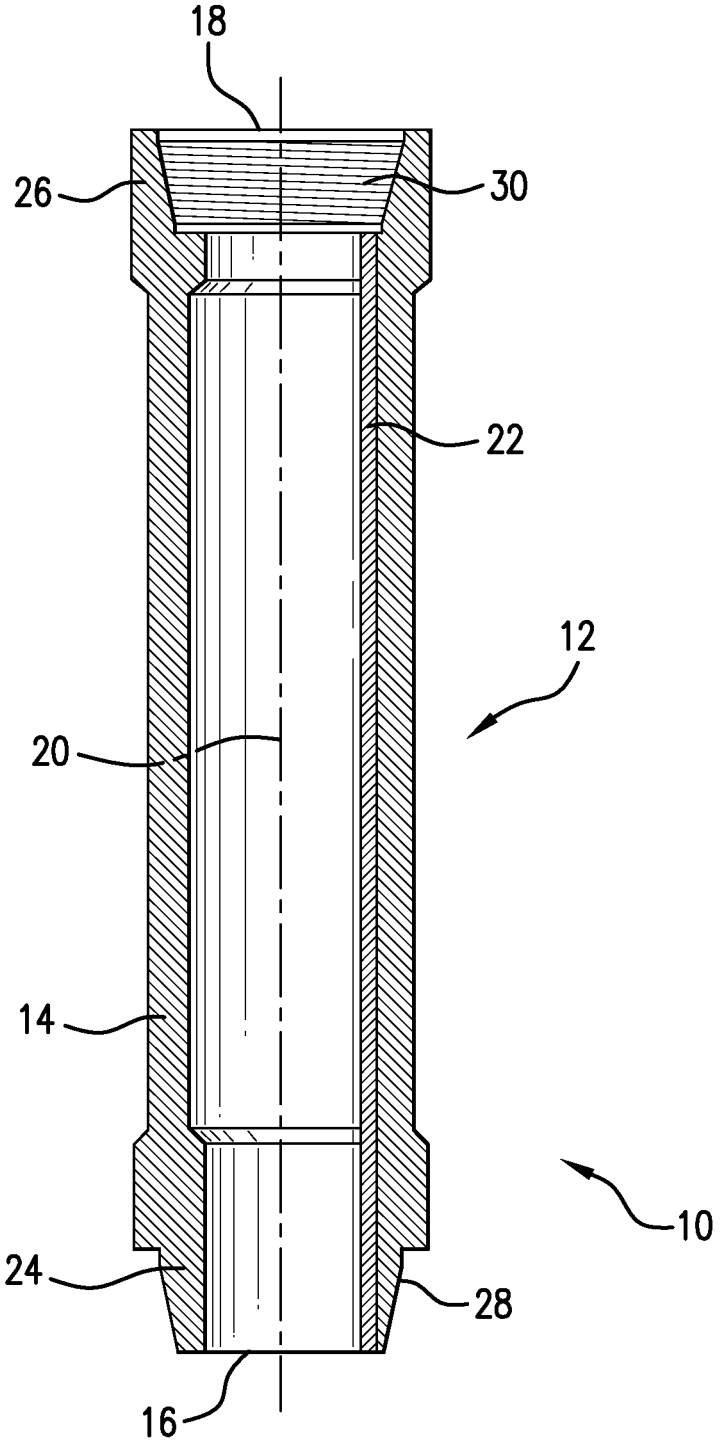
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole wall and is discharged into the mud tank or other location.

The string 12 may include at least one wired pipe segment 14 having an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein.

At least an inner bore or other conduit 20 extends along the length of each segment 14 to allow drilling mud or other fluids to flow there through. A transmission line 22 is located within the wired segment 14 to provide protection for electrical, optical or other conductors which can be part of the transmission line to be disposed along the wired segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric. In one embodiment, the shield layer is electrically coupled to an outer conductor that may be formed, for example, by a rigid or semi-rigid tube of a conductive material.

The segment 14 includes a downhole connection 24 and an uphole connection 26. The segment 14 is configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection therebetween to connect the segment 14 with another adjacent segment 14 or other downhole component. It shall be understood that a wired pipe segment may consist of several (e.g. three) segments. In one embodiment, the exterior of the male coupling portion 28 and the interior of the female coupling portion 30 are tapered. Although the pin end 24 and the box end 26 are described as having threaded portions, the pin end 24 and the box end 26 may be configured to be connected using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated or transmitted by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof Other carrier examples include casing pipes, wirelines, wireline sondes, slickline sondes, drop shots, downhole subs, BHA's and drill strings.

Figure 3:
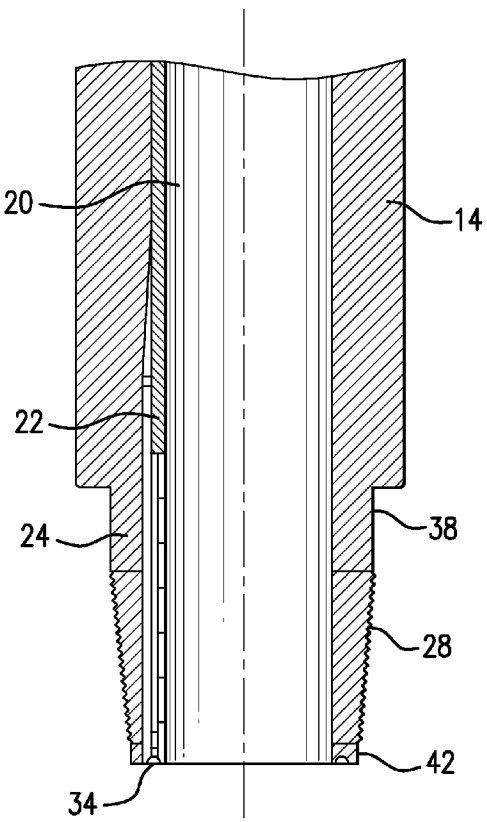
FIG. 3 depicts an exemplary embodiment of a pin end of the segment of FIG. 1.
Figure 2:
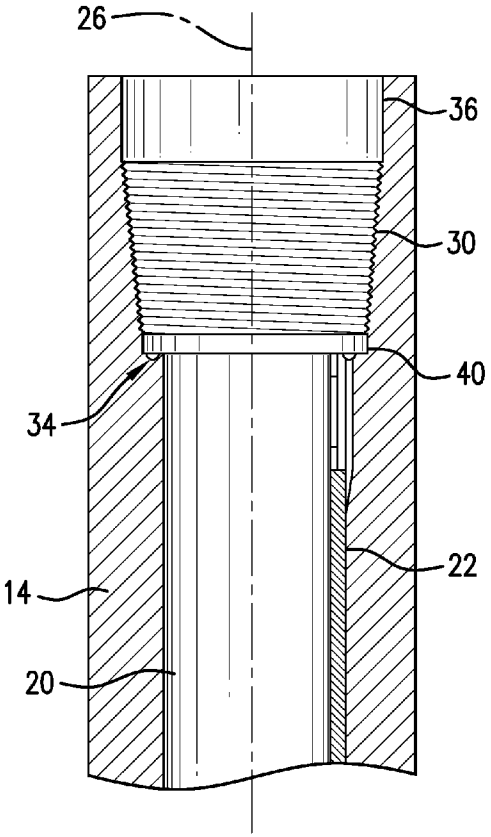
FIG. 2 depicts an exemplary embodiment of a box end of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. The transmission device 34 may be of any suitable type, such as an inductive coil, capacitive or direct electrical contacts, resonant coupler, or an optical connection ring. The coupler may be disposed at the inner or outer shoulder or in between. It shall be understood that the transmission device 34 could also be included in a repeater element disposed between adjacent segments 14 (e.g., within the box end). In such a case, the data/power is transmitted from the transmission device in one segment, into the repeater. The signal may then be passed "as is," amplified, and/or modified in the repeater and provided to the adjacent segment 14.

Regardless of the configuration, it shall be understood that each transmission device 34 can be connected to one or more transmission lines 22. Embodiments disclosed herein are directed how such transmission lines 22 can be formed. In one embodiment, a carrier (either a dielectric surrounded wire or a twisted pair) has a spirally deformed plate that is wrapped around it. One of ordinary skill will realize that several methods can be used to form the particular transmission lines disclosed herein.

Figure 4:
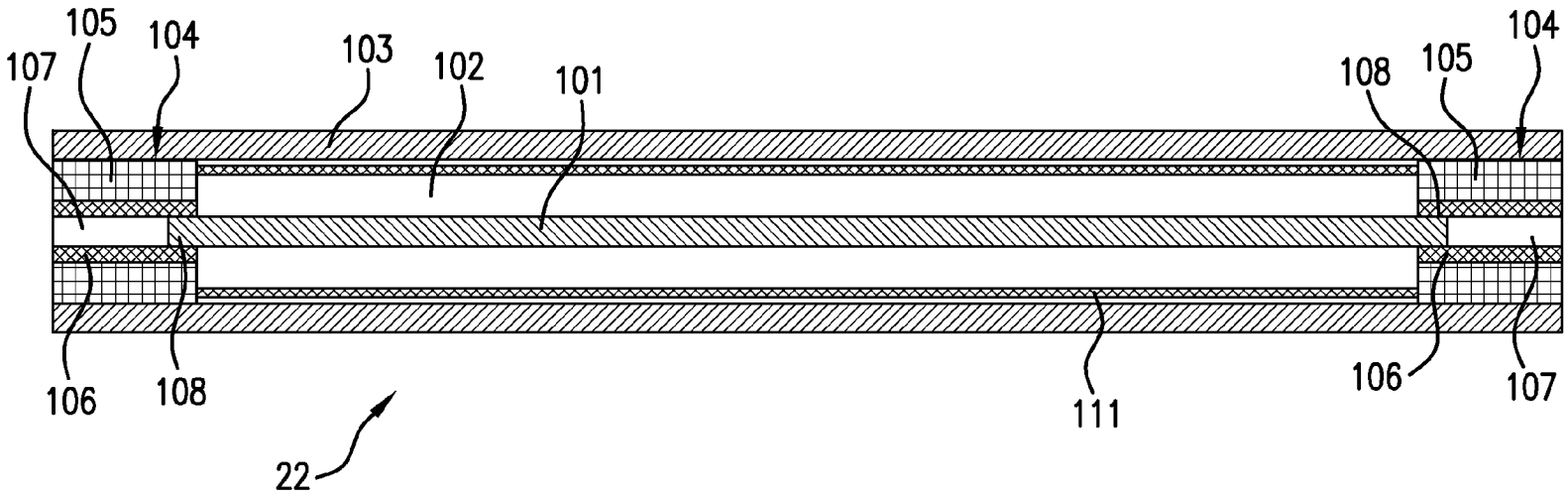
FIG. 4 shows a cut-away side view of a transmission line according to one embodiment.

In more detail, and referring now to FIG. 4, a cut-away side view of a transmission line 22 is illustrated. This embodiment includes an inner conductor 101 that may be formed of a solid or braided metallic wire. An insulating material such as dielectric layer 102 surrounds the inner conductor 101 for most of the length of the inner conductor 101. Also included is a shield layer 111 that surrounds the dielectric layer 102. The shield layer 111 may be formed of a highly conductive material such as copper or a copper alloy in one embodiment. In one embodiment, the shield layer 11 could be a braided layer.

The combination of the dielectric layer 102 and the inner conductor 101 can be formed in any known manner. In one embodiment, the combination is formed such that the dielectric material 102 and the inner conductor 101 are tightly bound.

As illustrated a portion 108 of the inner conductor 101 extend beyond an end of the dielectric layer 102. This portion 108 may be referred to as the inner conductor extension 108 from time to time herein. The inner conductor extension 108 provides a contact point for which an electrical connection to the coupler 34 (FIG. 3) can be made.

The illustrated transmission line 22 includes a connector 104 disposed at the ends of the dielectric layer 102. The connectors 104 serve to provide a means for providing for an electrical connection between the inner conductor 101 and a coupler 34. It shall be understood that the connectors 104 are optional and can be omitted in one embodiment.

The connectors 104 include a conductive region 106 that makes physical and electrical contact with the inner conductor 101. The conductive region 106 could be formed, for example, as a metallic tube. Surrounding the conductive region 106 is an insulating layer 105. The insulating layer 105 can be formed on any type of insulator including, for example, polyether ether ketone (PEEK), ceramic or a dielectric material.

As illustrated an outer conductor 103 surrounds the inner conductor 101, the dielectric layer 102 and optionally the connectors 104. The outer conductor 103 may be formed a rigid or semi-rigid conducting material around the inner assembly including the inner conductor 101/dielectric layer 102 and optionally the connectors 104. In one embodiment, the outer conductor 103 is formed of steel. In one embodiment, an adhesive material may be disposed between the inner assembly and the outer conductor 103 to ensure that the inner assembly and the outer conductor 103 do not move relative to one another. Further, it shall be understood that while a coaxial cable is shown herein, the inner assembly could be formed in other manners including, for example, as a twisted pair. In the illustrated embodiment, the outer conductor 103 could be formed as a rigid or semi-rigid casing that protects portions that it surrounds. In other embodiments, the outer conductor 103 may be formed of any type of conductive material and may not provide protection.

In one embodiment, the dielectric material 102 is formed of a silicon dioxide ($SiO_2$). The electrical properties of $SiO_2$ are approximately stable over the range of drilling temperature ranges. Further, using such a material as the dielectric may result in similar electrical properties of a polytetrafluoroethylene (PTFE) cable that is 30-50% smaller and lighter.

Figure 5:
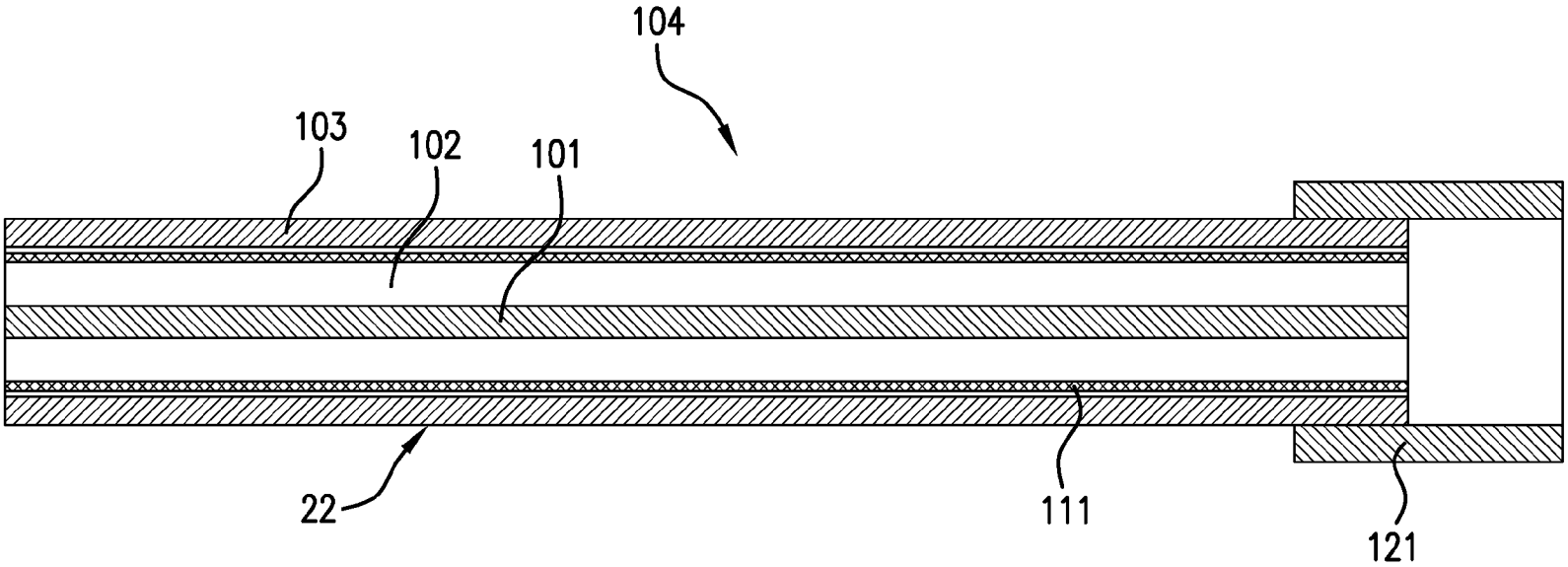
FIG. 5 shows a transmission line including a sealing sleeve.

In one embodiment, the transmission line 22 is formed such that the outer conductor 103 is formed of steel. In such an embodiment, and with reference now to FIG. 5, outer conductor 103 could be welded directly to a wired pipe segment or other component. As illustrated the outer conductor is welded to a sealing sleeve 121. The sealing sleeve 121 can be used, for example, to cover a connection from the transmission line 22 to a coupler 34 (FIG. 3) to isolate them from drilling mud. Further, in some cases the transmission line 22 is held in tension inside the drill pipe. In this case it may be beneficial to weld a load sleeve to the outer conductor 103 to transmit the tension force to the transmission line 22.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A wired pipe transmission line for disposal in a wired pipe segment for use in subterranean drilling, the transmission line comprising:

an assembly including an inner conductor and a dielectric layer including silicon dioxide ($SiO_2$) insulating material surrounding the inner conductor;

a protective layer that is formed of a rigid material and surrounding the dielectric layer;

a sealing sleeve welded to an outer side of the protective layer, wherein the sealing sleeve extends beyond an end of the protective layer; and a connector disposed within the sealing sleeve;

wherein a portion of the inner conductor extends beyond an end of the insulating material and is in electrical contact with the connector.

2. The transmission line of claim 1, further comprising:

a shield layer disposed between the dielectric layer and the protective layer.

3. The transmission line of claim 2, wherein the shield layer is at least partially formed of copper.

4. The transmission line of claim 1, wherein the rigid material is steel.

5. The transmission line of claim 1, wherein the connector is disposed within the protective layer.

* * * * *